US005165212A

United States Patent [19]

Arnold

[11] Patent Number: 5,165,212

[45] Date of Patent: Nov. 24, 1992

[54] HOLLOW PANEL WALL ASSEMBLY

[76] Inventor: Joseph R. Arnold, 1430 Chester Hwy., McConnells, S.C. 29726

[21] Appl. No.: 589,676

[22] Filed: Sep. 28, 1990

[51] Int. Cl.[5] ..... E04H 1/00

[52] U.S. Cl. ..... 52/586; 52/265

[58] Field of Search ..... 52/265, 285-286, 52/282, 586, 241, 243, 309.11, 588

[56] References Cited

U.S. PATENT DOCUMENTS

| | | | |
|---|---|---|---|
| 2,352,807 | 7/1944 | Sheldon | 52/586 |
| 2,356,309 | 8/1944 | Garbe . | |
| 2,662,252 | 12/1953 | Styles | 52/282 |
| 2,909,251 | 10/1959 | Nelsson . | |
| 2,994,413 | 8/1961 | Levy et al. . | |
| 3,027,605 | 4/1962 | Nelsson . | |
| 3,034,609 | 5/1962 | Young . | |
| 3,151,711 | 10/1964 | Ridder . | |
| 3,254,464 | 6/1966 | Hoyt, Jr. | 52/586 |
| 3,293,813 | 12/1966 | Emmons et al. . | |
| 3,369,335 | 2/1968 | Smith | 52/282 |
| 3,429,090 | 2/1969 | Metelnick . | |
| 3,533,205 | 10/1970 | Pestel et al. . | |
| 3,593,475 | 7/1971 | LaGue . | |
| 3,609,933 | 10/1971 | Jahn et al. . | |
| 3,623,290 | 11/1971 | Downing, Jr. . | |
| 3,712,015 | 1/1973 | Nelson . | |
| 3,820,299 | 6/1974 | Verholt . | |
| 4,016,690 | 4/1977 | Richardson . | |
| 4,114,333 | 9/1978 | Jones et al. . | |
| 4,142,335 | 3/1979 | Andrade . | |
| 4,557,091 | 12/1985 | Auer . | |
| 4,567,699 | 2/1986 | McClellan | 52/586 |
| 4,570,390 | 2/1986 | Wendt | 52/282 |
| 4,625,476 | 12/1986 | Shimada | 52/586 |
| 4,813,202 | 3/1989 | Anderson | 52/586 |
| 4,914,879 | 4/1990 | Goldberg | 52/586 |
| 4,964,252 | 10/1990 | Guliker | 52/282 |
| 5,014,476 | 5/1991 | Leslie et al. | 52/586 |

*Primary Examiner*—David A. Scherbel
*Assistant Examiner*—Michele A. Van Patten
*Attorney, Agent, or Firm*—Bell, Seltzer, Park & Gibson

[57] ABSTRACT

The present invention discloses a hollow panel wall assembly and kit design for simple and inexpensive building construction. The assembly comprises top and bottom elongate plates, studs, and wall panels. The elongate plates support both the wall panels and the vertical studs. The plates further have transverse channels into which fit the studs. The studs themselves have lengthwise grooves into which fit the tapered edges of the wall panels. This construction is easy to assemble and results in decreased housing manufacture costs.

6 Claims, 3 Drawing Sheets

HOLLOW PANEL WALL ASSEMBLY

BACKGROUND OF THE INVENTION

This invention relates generally to building structures, and, more specifically, it relates to a hollow panel wall assembly designed to be easily and economically constructed.

There is a continuing and ever increasing need for low and lower middle income housing. Most methods of construction, however, require significant manpower and skilled labor for assembly. Because the cost of skilled labor and unskilled labor is rising, it is difficult to construct homes that can be purchased by persons having low or lower middle incomes.

Further, construction quality tends to be directly related to the quality of labor used in the construction. If there is not quality labor available, then the resulting structure may be of questionable value.

There are also many types of alternative building systems for prefabricated, modular and manufactured housing presently available on the market that attempt to address the problem of modestly priced housing. Unfortunately, mobile homes and related manufactured housing are made with a limited number of floor plans, and they often are poorly made and have short useful lives. On the other hand, modular and prefabricated homes that can be assembled on site at many locations are often made with costly materials and require specialized labor to assemble. At the present time, there are simply no adequate assemblies comprised of relative inexpensive and available materials and that have simple labor demands for assembly.

Accordingly, it is the main object of this invention to provide a wall assembly which would provide housing and other buildings at a reasonable price to purchasers.

Further, it is an object of this invention to provide a wall assembly that may be quickly and easily manufactured by labor that is not necessarily highly skilled.

It is also an object of this invention to provide a wall assembly comprised of generally standardized materials for construction.

Another object of this invention is to provide a wall assembly that can be easily laid out and installed in virtually any floor plan desired by the eventual building owner.

A further object of the invention is to provide a wall assembly that is fully sealed to enhance heating and cooling energy efficiency.

An additional object of the invention is to provide a wall assembly that is integrally supported by several means to insure a stable and solid structure.

These together with other objects and advantages which will become subsequently apparent reside in the details of construction and operation as more fully hereinafter described in the claims, reference being had to the accompanying drawings forming a part hereof.

SUMMARY OF THE INVENTION

The present invention discloses a hollow panel wall assembly and kit designed for simple building construction. The panel wall assembly comprises top and bottom elongate plates, studs, wall panels, and fastener means for maintaining the wall assembly in place. The elongate plates have spaced-apart transverse channels that have substantially flat bottoms and are open ended. In addition to the transverse channels, the elongate plates have reduced thickness portions or flanges along the sides of the elongate plates. The flanges have flat surfaces substantially flush with the bottoms of the transverse channels. The studs are positioned upright in the transverse channels, and have a width substantially the same as the width of the transverse channels. The studs further have a pair of spaced-apart grooves extending throughout the length of each side of the face of the stud. The inner side of each groove in each face of the studs are substantially parallel to each other. The outer side of the groove extends at a diverging angle from the inside face of the groove. The wall panels have configured edges that are tapered to be matingly received in the grooves of the studs. Further, the panels abuttingly engage the flanges of the upper and lower plates. Fastener means are included to help secure the wall.

The components of this invention, the plates, the studs, and the panels are relatively standardized products. This cuts out a significant amount of custom work necessary in many modern buildings. Further, the lengthwise grooves in the face of the studs are flared so that the panels may be easily positioned in them and then snugly fit in place. This provides for rapid construction of a wall assembly, thereby reducing labor costs. As indicated, this new invention suggests an economically smart alternative to lower and lower-middle income housing. Even if the material costs of this type of construction were slightly higher than standard construction material costs, the savings in labor is significant, thus significantly reducing the price of the structure.

BRIEF DESCRIPTION OF THE DRAWINGS

Some of the features of the invention having been described, others will become apparent from the detailed description which follows, and from the accompanying drawings, in which.

DETAILED DESCRIPTION OF THE PREFERRED EMBODIMENT

Figure 1:
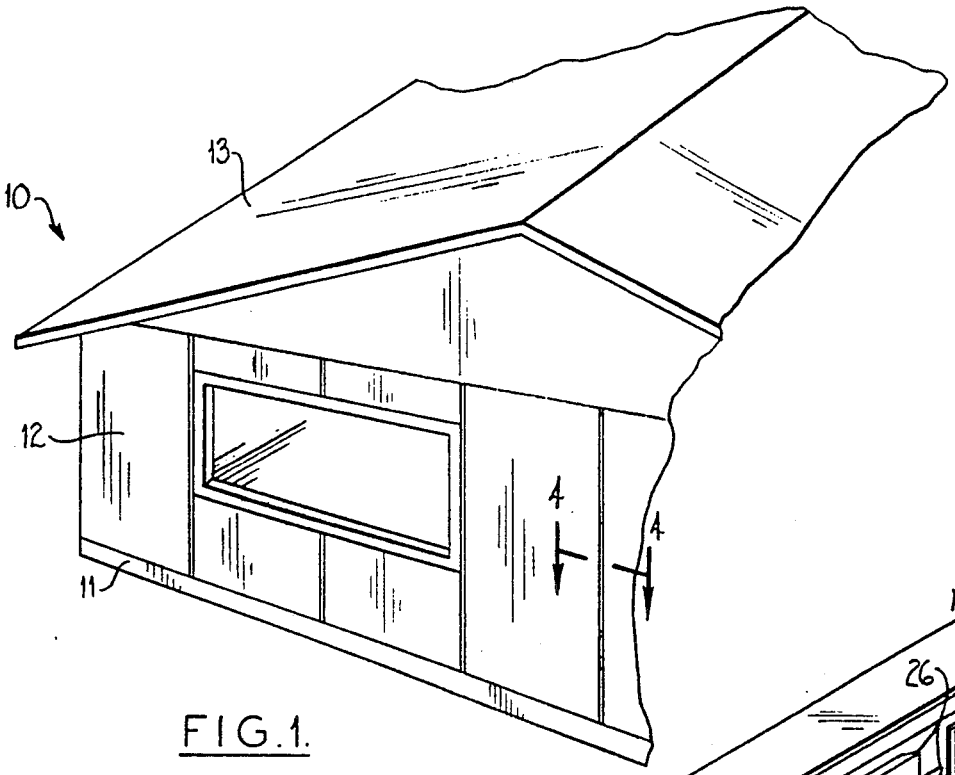
FIG. 1 is a fragmentary perspective view of a building utilizing the hollow wall assembly embodying the teachings of the present invention.

Shown in FIG. 1 is a building 10 constructed using the hollow panel wall assembly of the present invention. In general, the building includes a foundation 11 supporting side walls 12, and a roof 13. Typically, the foundation 11 is made of a concrete slab or similar inexpensive construction, although virtually any type of foundation is envisioned to be used in connection with the teachings of this invention. The walls 12 are a series of panels that are fitted together as described more fully herein. The roof 13 is typically made of prefab trusses covered with plywood and conventional roofing materials.

Figure 2:
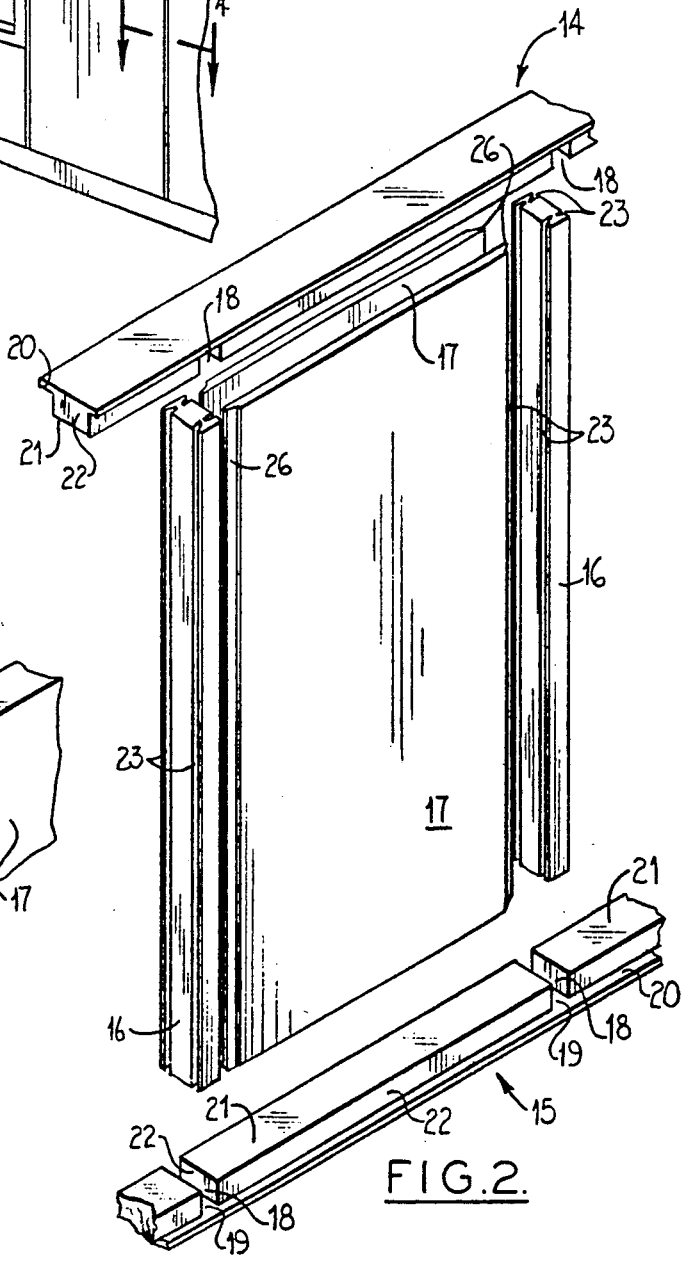
FIG. 2 is an exploded perspective view of a single section of a hollow panel wall assembly.
Figure 3B:
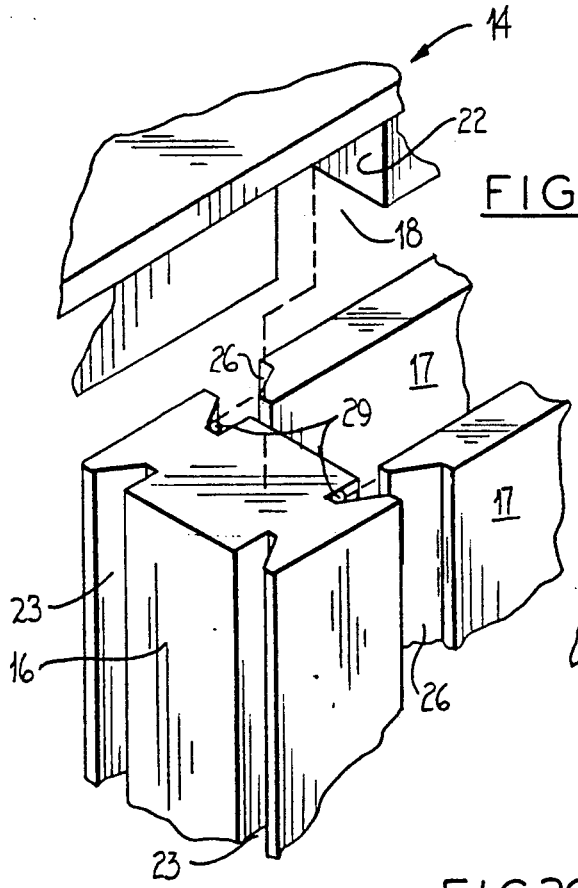
FIG. 3B is an exploded, fragmentary view similar to FIG. 3A showing the adhesive applied prior to assembly.
Figure 3C:
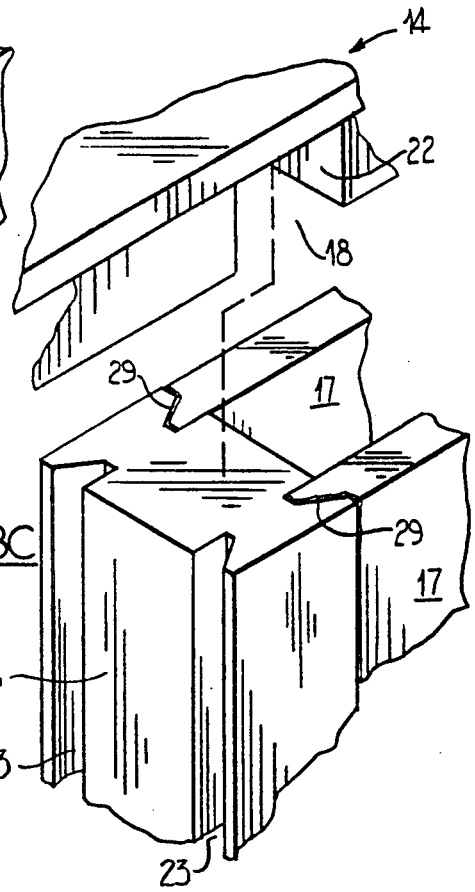
FIG. 3C is an exploded, fragmentary view showing the stud and panel in assembled relation.

FIG. 2 illustrates an exploded view of one segment of the wall assembly. As can be seen, the wall assembly is comprised of a top plate 14 and bottom plate 15, the bottom plate 15 being secured to the foundation by screws, nails or other suitable means. The wall further comprises studs 16 and pairs of wall panels 17 that when all joined together with the elongate plates form the completed hollow panel wall assembly as described more fully herein.

The top and bottom elongate plates 14 and 15 that form the top and bottom of the wall assembly are formed of wood and are of substantially identical construction. As best seen in FIG. 2, longitudinally spaced-apart transverse channels 18 are formed in the plates 14, 15 at regular intervals. The channels 18 of the bottom plate 15 are equally spaced apart in corresponding relationship to the channels 18 in the opposing top elongate plate 14. These channels 18 have substantially flat bottom surfaces 19. In practice, these channels are spaced apart at two foot intervals.

Again referring to FIG. 2, the bottom plate 15 and top plate 14 are each of a generally "T" shaped cross section and include a central portion 21 with reduced thickness portions projecting laterally outwardly from opposite sides of the central portion 21 to form longitudinally extending flanges 20. The flanges 20 project laterally outwardly from the sides 22 of the central portion 21 a distance which corresponds to the thickness of the panel 17. The flanges 20 have a flat surface which is substantially flush with the flat bottoms 19 of the transverse channels 18. In the assembled wall assembly, the surface of the flanges 20 and the sides 22 of the central portion 21 serve to support and stabilize the edge portions of the panel 17.

The studs 16 have a length corresponding to the longest dimension of the panels 17. A standard length in the industry for panels of the type shown is eight feet. The studs 16 have a thickness corresponding to the width of the channels 18 formed in plates 14 and 15, and a width which corresponds to the overall width dimension of the plates, i.e. the distance from the flange on one side to the flange on the opposite side. The studs are thus designed so that the ends of the studs readily fit into the channels 18 formed in the top and bottom plates 14, 15.

Figure 3A:
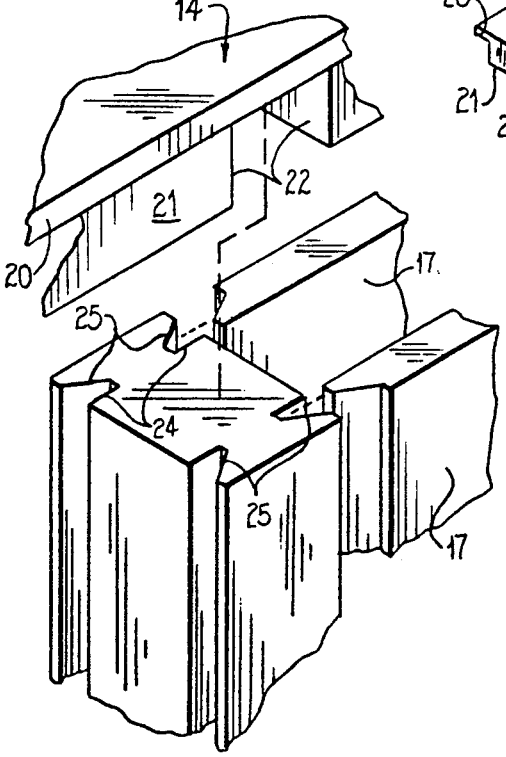
FIG. 3A is an exploded, fragmentary view of the end of a stud, the corner of a panel, and a portion of a plate.

On each face of the stud 16 is formed a pair of grooves 23. The grooves 23 are spaced inwardly from the corners of the stud a short distance and extend parallel to the corners and to one another for the full length of the stud. As best seen in FIG. 3A, the grooves are of a tapered configuration, with the width of the groove having a relatively wide opening at the surface of the stud and with the base of the groove being somewhat narrower. More particularly, the inward side 24 of each groove is generally perpendicular to the face of the stud, while the outward side 25 of the groove is formed at an acute angle to the face of the stud. The grooves 23 thus define a widemouth opening adapted to receive the side edges of the panels 17.

Figure 4:
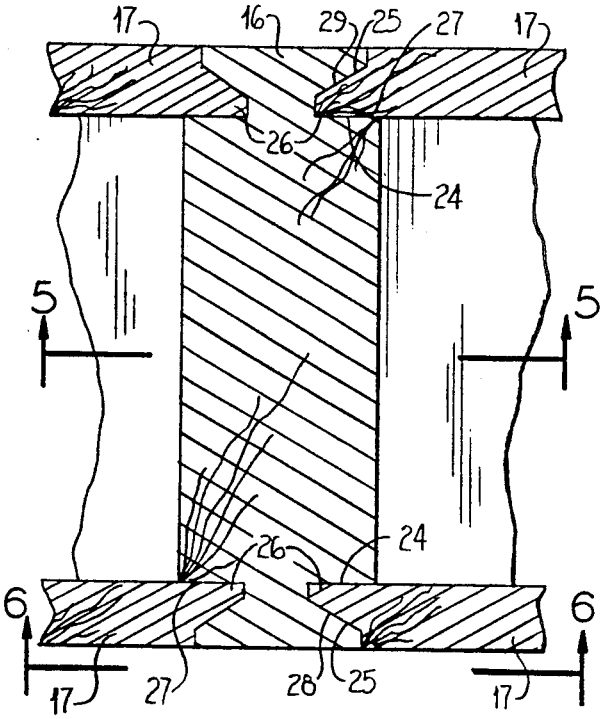
FIG. 4 is a cross-sectional view of the panel wall assembly taken along lines 4—4 of FIG. 1.
Figure 5:
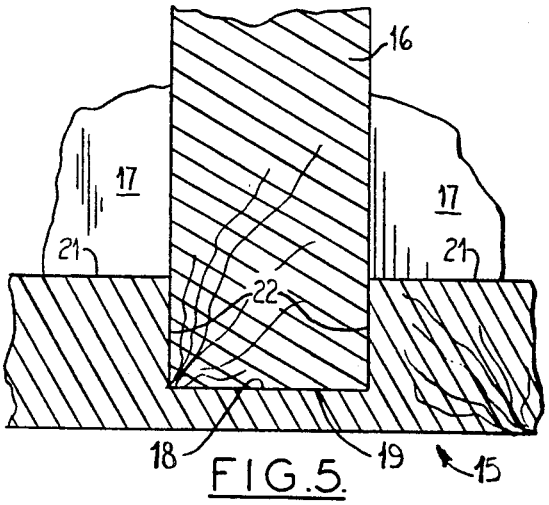
FIG. 5 is a sectional view along lines 5—5 of FIG. 4.
Figure 6:
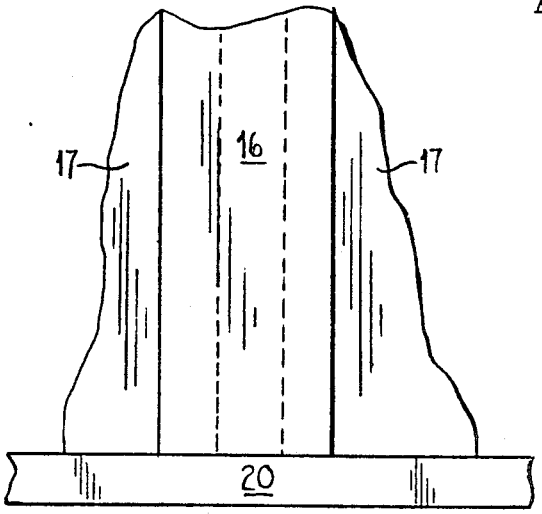
FIG. 6 is a side view along lines 6—6 of FIG. 4.

The panels 17 have configured longitudinal edges 26 that are tapered to be matingly received in said lengthwise groove 23. Referring to FIG. 4, the inside 27 of the tapered edge 26 is flat so as to lie in full contact with the flat inner edge 24 of said lengthwise grooves 23 of the stud 16. The taper is on the outside of the edge 26 corresponds to the diverging angle of the outer side 25 of the groove 23.

The wall panels 17 are typically made of a particle board or similar plywood composition. These panels have a tendency to warp or otherwise not be true even in the best conditions and after the most careful manufacture. Therefore, if the grooves 23 or the tapered edge 26 were of a more precise structure that demands a perfect fit, then the panel would be extremely difficult if not impossible to fit or otherwise engage in the grooves 23 as a result of the anticipated imperfections. By having a tapered edge 26 and a tapered groove 23, the panel may be slightly warped but still possible to initiate within the groove of the studs and fit snugly.

Regardless of the tendency to warp, the tapered edges and grooves of the present invention are a significant facilitator in assembling the hollow panel wall. The tapered components allow an easier initiation of the edge into the groove and result in a tighter fit, because the edges 26 are literally wedged into the grooves 23 thereby assuring a tight fit with no slipping.

In practice, a building manufacturer can obtain a kit or modify existing planing and routing machinery to mass produce a kit comprising a number of the elongate plates 14 and 15, vertical studs 16, and wall panels 17 that have been described fully herein. He can then pour a slab or foundation to a building and lay out the wall design by merely laying the track of lower elongate plates in whatever wall pattern is desired. The builder can then position the studs in the transverse channels one at a time, and place a pair of panels on each of the flanges of the elongate plate, abutting the central portion of the elongate plate for support, and fit the edges into the grooves of the studs. A second stud is then placed in the neighboring channel to engage the tapered edges of the opposite side of the panels and secure them on the flanges of the elongate plate. Finally, the upper elongate plate is positioned so that the transverse grooves of the upper elongate plate lock the studs in place and in a secure relationship with the wall panels. The result is a hollow wall assembly having superior strength and insulation characteristics.

To further reduce the leakage of air and other elements into the building, insulating foam or materials can be introduced in between the panels before the top plate is secured, or caulking material 29 or other adhesive compound can be applied to the tapered edges 26 or to the lengthwise grooves 23 in the studs and also along the wall of the central portion 21 of the elongate plate abutting the panel before the panel is positioned in the grooves. This adds integrity to the wall both structurally and for insulating purposes.

Obviously, many modifications and other embodiments of the subject invention will readily come to one skilled in the art having the benefit of the teachings presented in the foregoing descriptions and accompanying it with the associated drawings. Therefore, it is to be understood that the invention is not to be limited thereto and that the modifications and embodiments are intended to be included within the scope of the appended claims.

That which is claimed is:

1. A hollow panel wall assembly of wooden construction comprising opposing top and bottom elongate plates having opposing correspondingly spaced apart transverse channels formed therein, said channels having substantially flat bottoms and being open ended, reduced thickness flange portions provided along opposing side portions of said top and bottom plates and extending along the ends of said transverse channels, said flange portions having flat surfaces positioned substantially flush with the bottoms of said transverse channels, upright studs positioned in said opposing transverse channels in said top and bottom plates, said studs having a width of substantially the same as said top and bottom plates and a thickness substantially corresponding to the width of said transverse channels, each of said studs having a pair of spaced apart grooves extending throughout its length on each side face thereof, respective ends of said pairs of grooves being positioned to terminate adjacent respective ends of said transverse channels and at right angles thereto, inner sides of each pair of said grooves being substantially parallel to each other and extending at substantially a right angle to said side faces of said studs, outer sides of each pair of said grooves being divergingly arranged to said inner sides of said grooves to define a wide mouth opening for the grooves, pairs of panels positioned between adjacent studs and having configured longitudinal edges matingly received in said pairs of grooves of said studs, opposing ends of said panels abuttingly engaging said flange portions of said upper and lower plates, and fastener means cooperating with said panels, said studs and said top and bottom plates for maintaining the wall assembly intact.

2. A hollow panel wall assembly according to claim 1 wherein said fastener means includes adhesive means positioned within said transverse grooves and said pairs of spaced apart grooves for aiding in providing a more air tight wall construction.

3. A hollow panel wall assembly according to claim 1 wherein the thickness of said panels is substantially equal to the distance from said inner sides of said grooves in said studs to the exterior sides of the studs adjacent the diverging outer sides of said grooves so that the panels are substantially flush with the exterior sides of the studs.

4. A hollow panel wall assembly according to claim 1 wherein said studs are positioned about two feet apart and said studs are about eight feet in length, and said panels are about two feet by eight feet and of a half an inch in thickness.

5. A hollow panel wall kit of wooden construction and comprising elongate plates having spaced-apart transverse channels formed therein, said channels having substantially flat bottoms and being open ended, reduced thickness flange portions provided along opposing side portions of said plates and extending along the ends of said transverse channels, said flange portions having flat surfaces positioned substantially flush with the bottoms of said transverse channels, studs adapted for positioning in said transverse channels in said plates, said studs having a width of substantially the same as said plates and a thickness substantially corresponding to the width of said transverse channels, each of said studs having a pair of spaced-apart grooves extending throughout its length on each face thereof, respective ends of said pairs of grooves being positioned to terminate adjacent respective ends of said transverse channels and at right angles thereto, inner sides of each pair of said grooves being substantially parallel to each other and extending at substantially a right angle to said side faces of said studs, outer sides of each pair of said grooves being divergingly arranged to said inner sides of said grooves to define a wide mouth opening for the grooves, panels adapted for positioning between studs and having configured longitudinal edges adapted to be matingly received in said grooves of said studs, opposing ends of said panels adapted for abuttingly engaging said flange portions of said plates, and fastener means for maintaining the wall intact once it is positioned together.

6. A hollow panel wall kit according to claim 5 wherein the thickness of said panels is substantially equal to the distance from said inner sides of said grooves in said studs to the exterior sides of the studs adjacent to diverging outer sides of said grooves.

* * * * *

UNITED STATES PATENT AND TRADEMARK OFFICE

CERTIFICATE OF CORRECTION

PATENT NO. : 5,165,212

DATED : November 24, 1992

INVENTOR(S) : Arnold

It is certified that error appears in the above-identified patent and that said Letters Patent is hereby corrected as shown below:

Column 3, line 66, "is" should be -- 28 --.

Signed and Sealed this

Nineteenth Day of October, 1993

Bruce Lehman

*Attest:*

BRUCE LEHMAN

*Attesting Officer*

*Commissioner of Patents and Trademarks*